US008851708B2

(12) United States Patent
Yasuji Fletcher et al.

(10) Patent No.: US 8,851,708 B2
(45) Date of Patent: Oct. 7, 2014

(54) DEVICE AND METHOD FOR LIGHT FIXTURE LOCKING MECHANISM

(75) Inventors: Robert Kenneth Yasuji Fletcher, Racine, WI (US); Erwin W. Greenwaldt, Milwaukee, WI (US)

(73) Assignee: Phoenix Products Company, Inc., Milwaukee, WI (US)

( * ) Notice: Subject to any disclaimer, the term of this patent is extended or adjusted under 35 U.S.C. 154(b) by 211 days.

(21) Appl. No.: 13/483,363

(22) Filed: May 30, 2012

(65) Prior Publication Data

US 2013/0322099 A1 Dec. 5, 2013

(51) Int. Cl.
*F21V 21/30* (2006.01)
*F21Y 105/00* (2006.01)

(52) U.S. Cl.
CPC ..... *F21V 21/30* (2013.01); *F21Y 2105/001* (2013.01)
USPC ..... 362/269; 362/249.03; 362/277

(58) Field of Classification Search
USPC ..... 362/238, 242, 249.1, 269, 282, 285, 362/287, 370, 427, 249.03, 239
See application file for complete search history.

(56) References Cited

U.S. PATENT DOCUMENTS 5,473,523 A * 12/1995 Von Fange ..... 362/232
2010/0118534 A1* 5/2010 Lo ..... 362/249.02

* cited by examiner

*Primary Examiner* — Diane Lee
*Assistant Examiner* — Gerald J Sufleta, II
(74) *Attorney, Agent, or Firm* — Whyte Hirschboeck Dudek SC

(57) ABSTRACT

Disclosed herein is a light fixture locking mechanism that includes a frame assembly having a first primary rod support and a second primary rod support, a first connecting rod having a first end and a second end, the ends extending substantially between the first primary rod support and the second primary rod support, and a plurality of aiming assemblies, each configured to receive the first connecting rod therethrough, the aiming assemblies including opposing engaging protrusions. The device further includes a first fastener, that when in a fastened position, the first and second primary rod supports are forced inwards towards each other to provide an engaging force on the opposing engaging portions of the aiming assemblies to prevent rotation of the first light module about the first connecting rod, and when in an unfastened position, the first and second light modules are both rotatable about the first connecting rod.

18 Claims, 16 Drawing Sheets

128
138
152
153
136, 146
130
136, 145
144
142
147
145
146
140
178
159
226
216
174
158
168
170
154
260
240
180
241
131
171
155
160
156
129

DEVICE AND METHOD FOR LIGHT FIXTURE LOCKING MECHANISM

FIELD OF THE INVENTION

The present invention relates to the field of lighting, more particularly, light fixture adjusting and locking mechanisms.

BACKGROUND OF THE INVENTION

Various types of lighting fixtures can include a series of lighting modules that can be aimed to direct light in different directions. The aiming and securing of the modules in a fixed direction can be difficult to accomplish, requiring extensive adjustments. Light fixtures mounted in high locations which require ladder or lift access are typically aimed once they are installed to achieve the desired lighting effect. Operating complex adjusting and securing mechanisms at a high elevation can be dangerous for an operator, particularly when the mechanisms are difficult and/or require accessing numerous parts around the fixture. In addition, when a fixture has many modules, it can be necessary for an operator to spend considerable time attempting to aim each module, creating a high burden, particularly when numerous fixtures are installed in a project. Accordingly, it would be desirable to overcome one or more of the above deficiencies.

BRIEF SUMMARY OF THE INVENTION

In at least some embodiments, the light fixture locking mechanism relates to a device that includes a frame assembly having a first primary rod support and a second primary rod support, a first connecting rod having a first end and a second end, the ends extending substantially between the first primary rod support and the second primary rod support, and a plurality of aiming assemblies, each configured to receive the first connecting rod therethrough, the aiming assemblies including opposing engaging protrusions, wherein one or more aiming assemblies are secured to a first light module that includes one or more light sources and one or more aiming assemblies are secured to a second light module that includes one or more light sources. The device further includes a first fastener for releasably securing the first end of the first connecting rod to the first primary rod support, wherein the second end of the first connecting rod is secured to the second primary rod support, wherein when the first fastener is in a fastened position, the first and second primary rod supports are forced inwards towards each other to provide an engaging force on the opposing engaging portions of the aiming assemblies to prevent rotation of the first light module about the first connecting rod, and wherein when the first fastener is in an unfastened position, the first and second light modules are both rotatable about the first connecting rod.

In at least some embodiments, the light fixture locking mechanism relates to a method of aiming a plurality of light modules that includes providing a frame assembly with a connecting rod secured thereto, providing at least two light modules in a longitudinal end-to-end configuration, wherein each light module forms a part of at least one aiming mechanism per light module, and positioning the connecting rod through at least a portion of the aiming mechanism. The method further includes unfastening at least one fastener to disengage a plurality of mating engaging protrusions that are included with each aiming mechanism to unlock the light modules to allow for reorientation of the light modules with respect to the frame assembly, rotating one or more of the light modules with respect to the connecting rod and fastening the at least one fastener to engage the plurality of mating engaging protrusions to lock the light modules in position relative to the frame assembly.

In at least some other embodiments, the light fixture locking mechanism relates to a device that includes a frame assembly having a first primary rod support and a second primary rod support, a connecting rod having a first end and a second end, the ends extending substantially between the first primary rod support and the second primary rod support, and a first and a second aiming assembly, both configured to receive the connecting rod therethrough, the two aiming assemblies including opposing engaging protrusions, wherein the aiming assemblies are secured to a first light module that includes one or more light sources and the first light module is rotatable with respect to the connecting rod. The device further includes a first fastener for releasably securing the first end of the connecting rod to the first primary rod support, wherein the second end of the connecting rod is secured to the second primary rod support, wherein when the first fastener is in a fastened position, the first and second primary rod supports are forced inwards towards each other to provide an engaging force on the opposing engaging portions of the aiming assemblies to prevent rotation of the first light module about the connecting rod, and wherein when the first fastener is in an unfastened position, the first light module is rotatable about the connecting rod.

Other embodiments, aspects, features, objectives and advantages of the present invention will be understood and appreciated upon a full reading of the detailed description and the claims that follow.

BRIEF DESCRIPTION OF THE DRAWINGS

Embodiments of the device and method for light fixture locking mechanism are disclosed with reference to the accompanying drawings and are for illustrative purposes only. The device and method for light fixture locking mechanism is not limited in its application to the details of construction or the arrangement of the components illustrated in the drawings. The device and method for light fixture locking mechanism is capable of other embodiments or of being practiced or carried out in other various ways. Like reference numerals are used to indicate like components. In the drawings.

DETAILED DESCRIPTION OF THE PREFERRED EMBODIMENT

Figure 1:
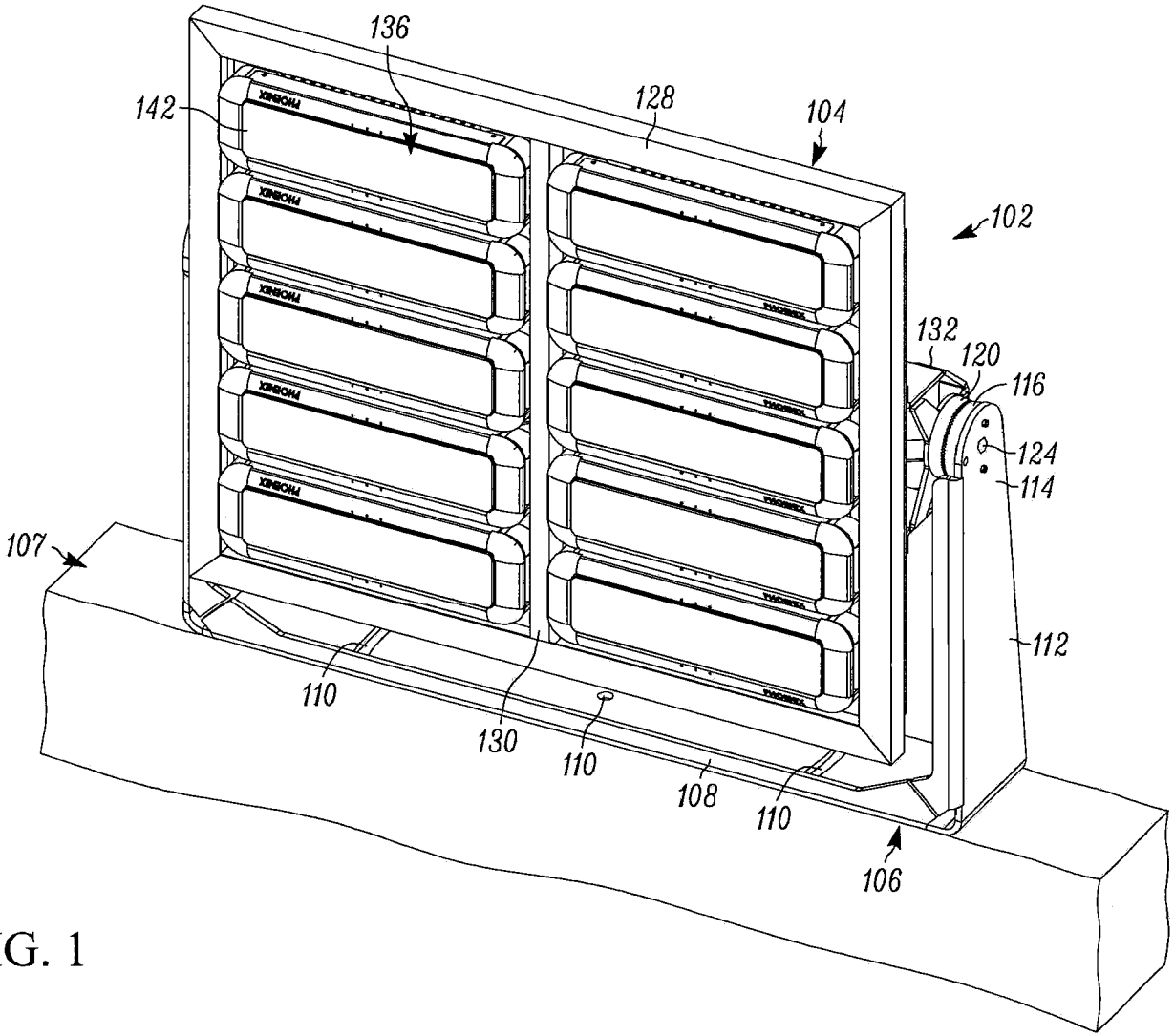
FIG. 1 is a perspective view of a first exemplary light fixture.
Figure 2:
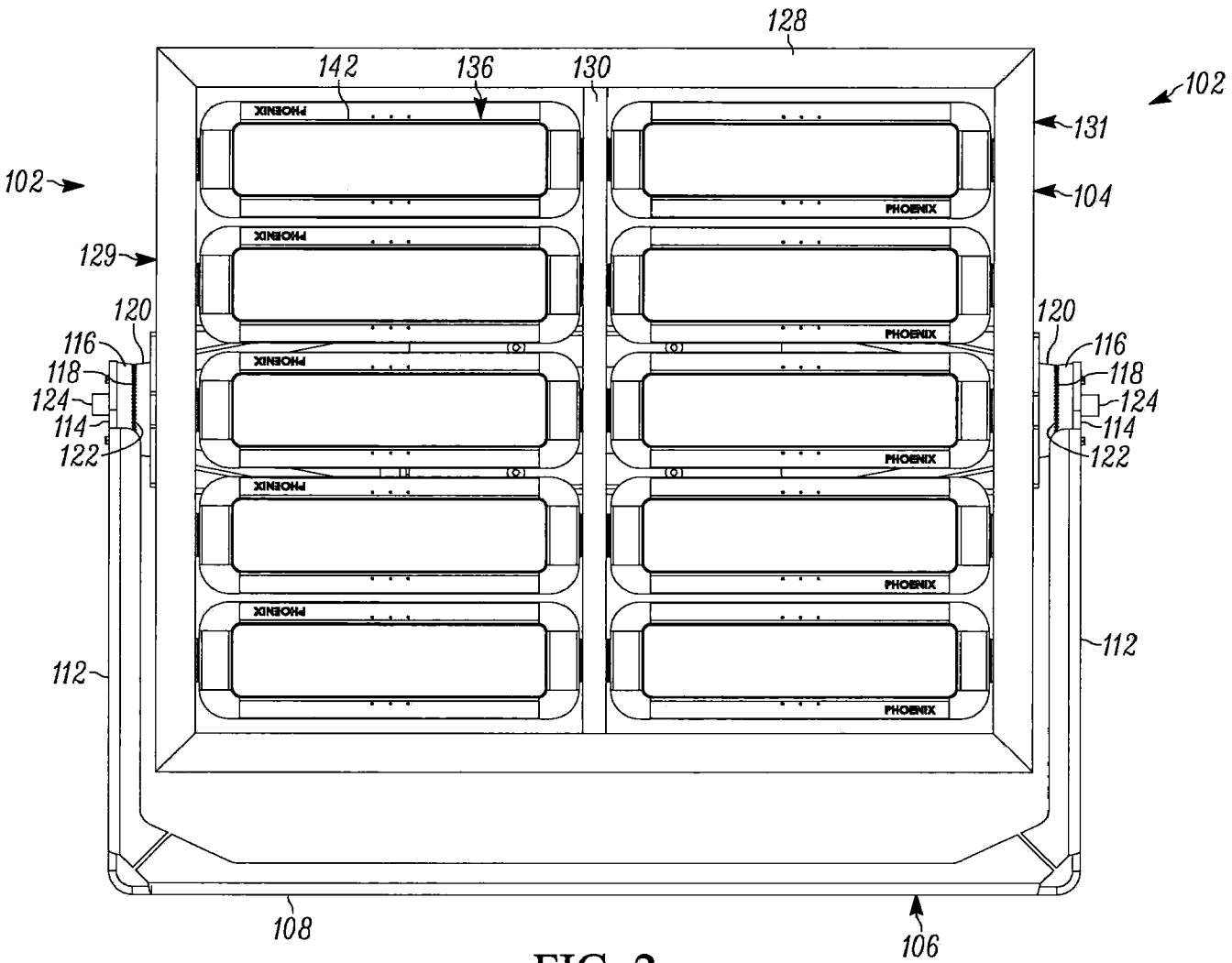
FIG. 2 is a front view of FIG. 1.

Referring to FIGS. 1 and 2, a perspective and front view of an exemplary light fixture 102 is provided. The light fixture 102 includes a frame assembly 104 rotatably secured to a mounting bracket 106. The mounting bracket 106 is utilized for securing the light fixture 102 to an object 107, such as a wall, a pole, a crane, etc., as well as to allow the frame assembly 104 to be tilted with respect to the object 107. The mounting bracket 106 includes a bracket base 108 with a plurality of fastening apertures 110 for receiving a plurality of fasteners (not shown) that can be used to secure the mounting bracket 106 to the object 107. The fastening apertures 110 can include various sizes and shapes, such as slots, holes, tabs, etc. The mounting bracket 106 further includes bracket arms 112 that extend from the bracket base 108. The bracket arms 112 include bracket support ends 114 that are rotatably secured to the frame assembly 104. The bracket support ends 114 include adjusting washers 116, where the adjusting washers 116 include a plurality of radial ridges 118. Similarly, the frame assembly 104 includes opposing adjusting washers 120 with a plurality of radial ridges 122. The adjusting washers 116, 120 are fixed about their respective locations, such that when the securing bolts 124 that extend through the bracket support end 114 and into the frame assembly 104 are loosened, the frame assembly 104 can be rotated, and when the securing bolts 124 are tightened, the radial ridges 118, 122 engage each other to fix the position of the frame assembly 104.

The frame assembly 104 further includes a frame body 128 and, in at least some embodiments, a frame cross-member 130 secured to, or formed therewith, the frame body 128. The frame body 128 extends about the perimeter of the frame assembly 104. The frame body 128 and frame cross-member 130 can include various shapes, such as square tube, round tube, etc. As illustrated, the frame body 128 is rectangular, although various other shapes, such as square, can be provided to accommodate desired shape and illumination characteristics. For reference, the frame body 128 includes an adjusting frame side 129 and a fixed frame side 131.

Figure 3:
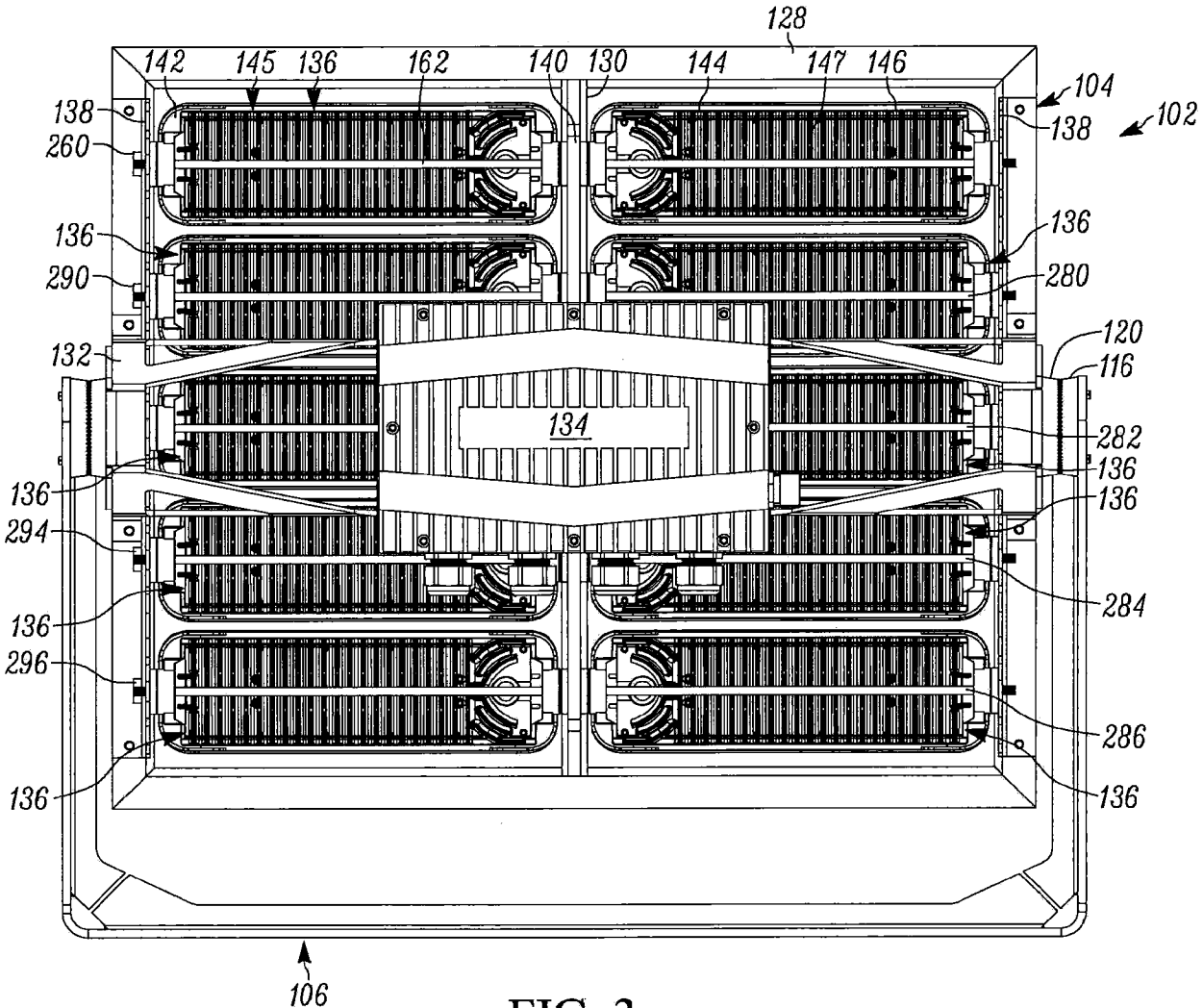
FIG. 3 is a rear view of FIG. 1.

Referring additionally to FIG. 3, a rear view of the light fixture 102 of FIG. 1 is provided illustrating the frame assembly 104 secured to a frame support 132 that can traverse the length of the frame body 128, or otherwise be secured to one or more portions of the frame assembly 104. The frame support 132 is utilized to secure the frame assembly 104 to the mounting bracket 106 and can include various shapes and configurations as desired to accommodate the various shape and weight requirements of a particular light fixture 102. In addition, the frame support 132 can provide a mounting point for mounting a driver box 134. The driver box 134 includes various electronic components, such as ballasts, transformers, fuses, etc., which are used to power one or more light sources (see FIG. 8) attached to the frame assembly 104.

Referring still to FIGS. 1-3, a plurality of light modules 136 is provided. The light modules 136 each include one or more of various light sources, such as light emitting diodes (LED), organic light emitting diode (OLED), halogen lamps, high intensity discharge (HID) lamps, plasma, etc. The light modules 136 include a lens cover 142 for protecting the light source(s) and, in at least some embodiments, to provide a desired diffusion of the emitted light. In addition, the light modules 136 include a module base 144, to which the lens cover 142 is secured. The module base 144 is configured to at least indirectly house and/or secure the light source(s), and further can include one or more heat sinks 147 to dissipate heat generated by the light source(s).

The light modules 136 are rotationally secured to the frame assembly 104 by one or more primary rod supports 138 and one or more secondary rod supports 140 (see FIG. 3). The inclusion and quantity of each of the supports 138, 140 is dependent on various factors, such as how many light modules 136 are to be mounted to the frame assembly 104 and in what configuration they will be positioned (e.g., single column, double column, single row, double row, etc.). The exemplary embodiment illustrated in FIGS. 1-3 includes two columns and five rows of light modules 136. With this configuration, a primary rod support 138 is secured on either side of the frame body 128 and a secondary rod support 140 is secured to the cross-member 130. This allows for the support of two columns of light modules 136 positioned in an end-to-end configuration.

Figure 5:
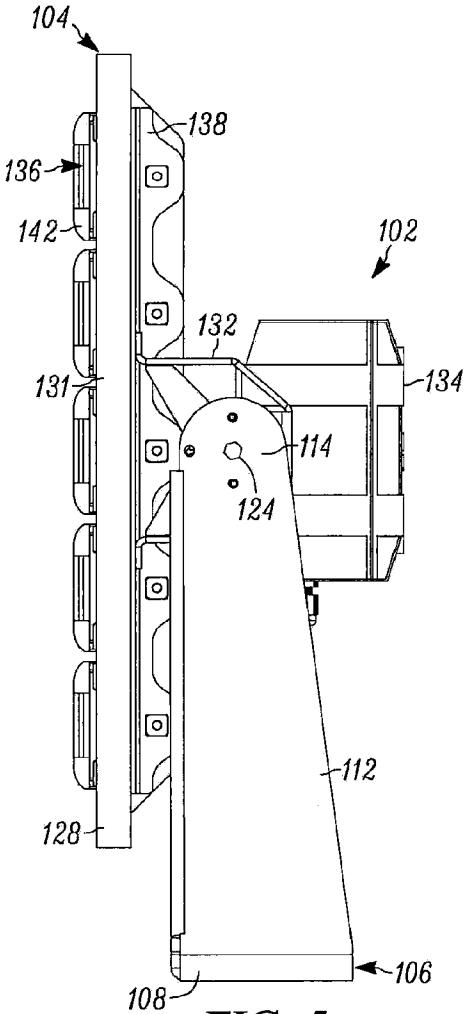
FIG. 5 is a right side view of FIG. 1.
Figure 4:
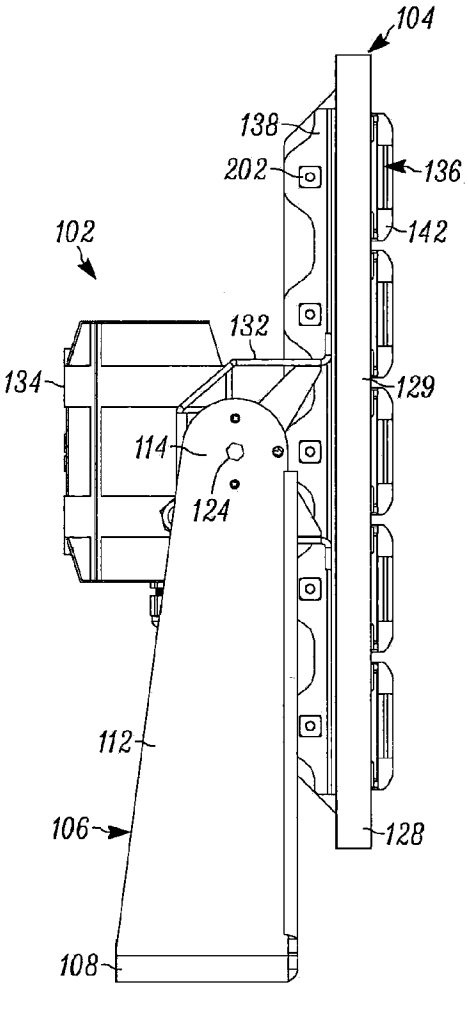
FIG. 4 is a left side view of FIG. 1.
Figure 6:
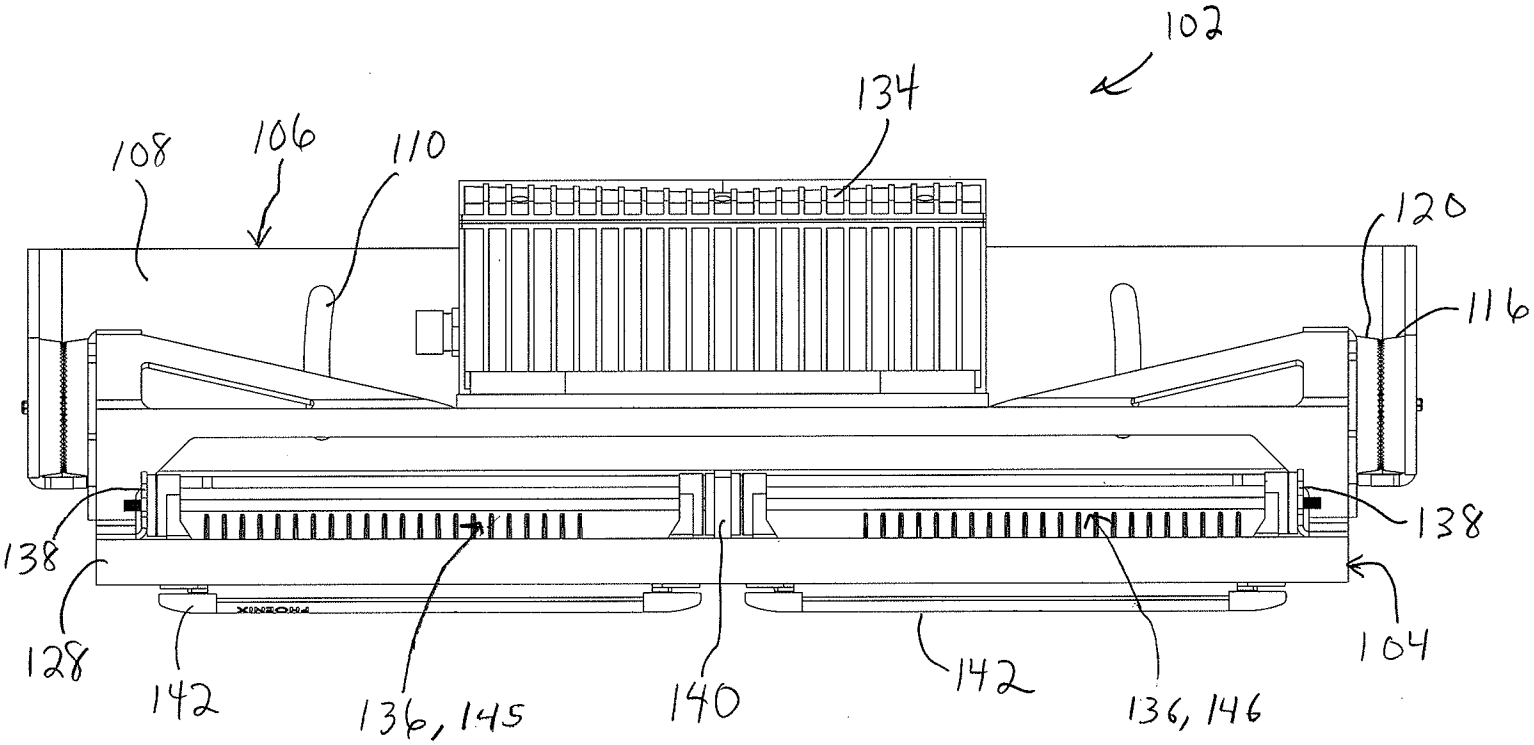
FIG. 6 is a top view of FIG. 1.
Figure 7:
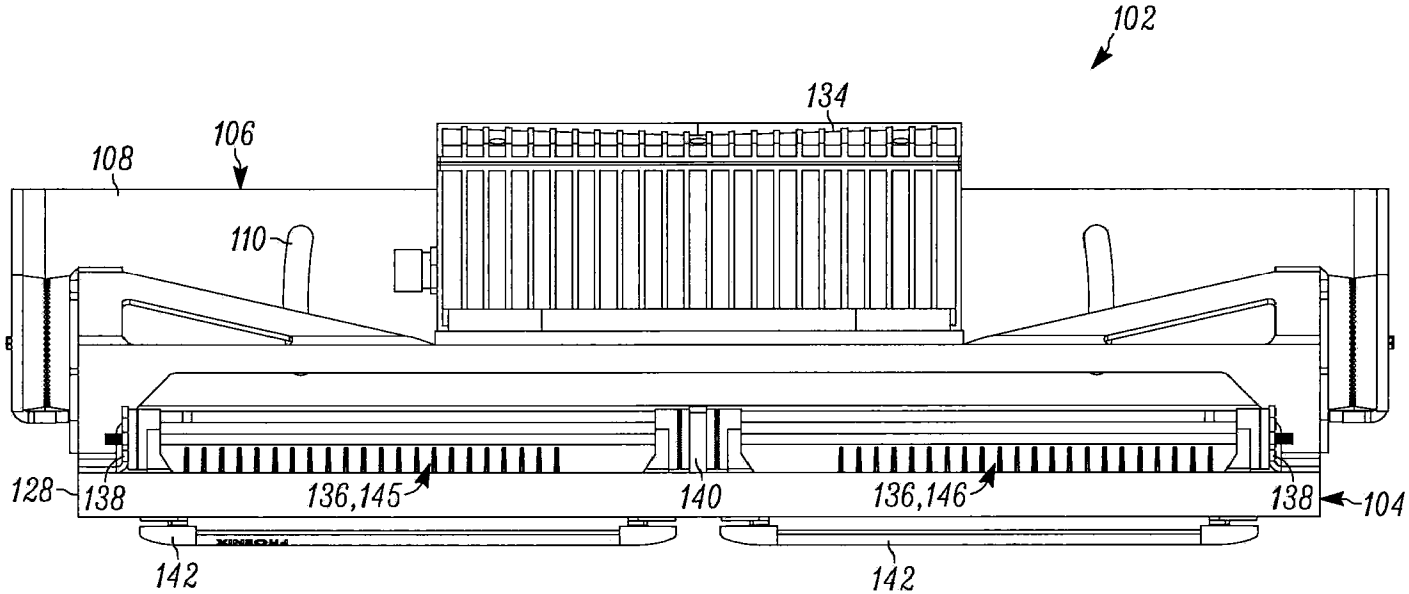
FIG. 7 is a bottom view of FIG. 1.

Referring to FIGS. 4-7, additional views of the light fixture 102 of FIG. 1 are provided. In particular, FIGS. 4 and 5 provide left side and right side views, respectively, of the light fixture 102. As illustrated in FIGS. 4 and 5, the primary rod supports 138 can be formed as a single length of material that extends along the frame body 128 on two sides to receive a plurality of connecting rods 162, although in other embodiments, the primary rod supports 138 can include a plurality of individual lengths for securing each connecting rod 162 to the frame assembly 104 separately. Likewise, as illustrated, the secondary rod support 140 can be a single length of material that extends along and is secured to the frame cross-member 130, or can include a plurality of individual lengths for separately receiving connecting rods therethrough. In addition, although the primary rod supports 138 and the secondary rod support 140 are illustrated as L-shaped brackets secured to the frame body 128, they can also be formed at least partially integral with the frame body 128 or another portion of the frame assembly 104. FIGS. 6 and 7 provide top and bottom views, respectively, of the light fixture 102 further illustrating the aforementioned components.

Figures 8, 9, 10:
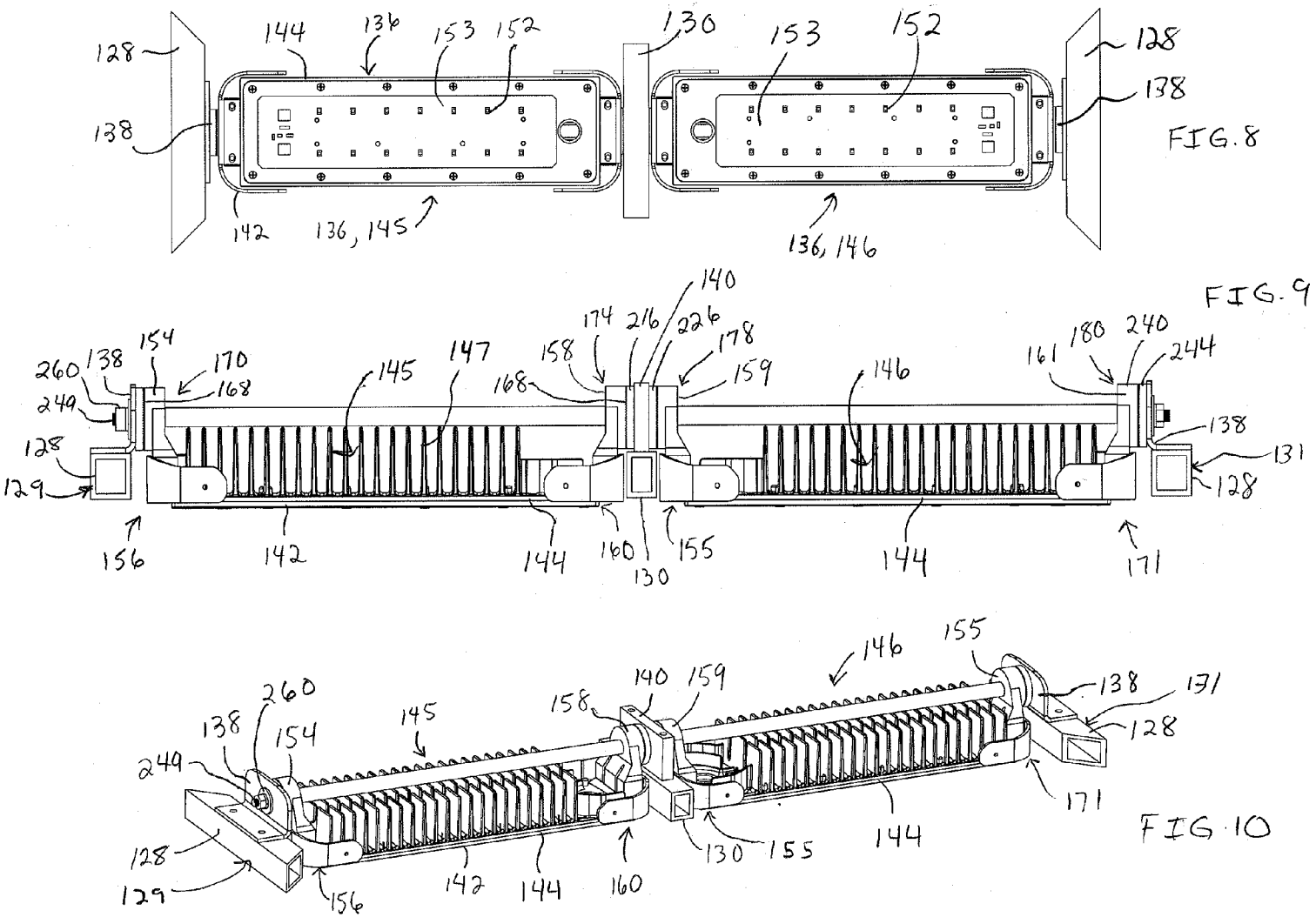
FIG. 8 is a partial view of the light fixture of FIG. 2.
FIG. 9 is a side view of FIG. 8.
FIG. 10 is a rear perspective view of FIG. 8.

Referring to FIG. 8, a partial view of the light fixture 102 shown in FIG. 2 is illustrated that includes a first light module 145 and a second light module 146 which are situated in an end-to-end configuration. The lens cover 142 has been removed to reveal the light sources. The light source for each light module 145, 146 includes a plurality of LEDs 152 mounted on a circuit board 153, although other types of light sources, with or without a circuit board, can be used, such as plasma, OLED. The circuit board 153 is mounted to the module base 144 on each light module 145, 146. The module base 144 can take various forms to accommodate the various components of the light modules 145, 146. It should be noted that although FIG. 8 depicts only a single row of light modules 145, 146, the other four rows of light modules 136 in the light fixture 102 include a similar configuration with similar components, as discussed further below. Additionally, although the light fixture 102 is shown with five rows and two columns of light modules 136, a greater or lesser quantity of rows and columns of light modules 136 can be included in the light fixture 102.

Referring to FIGS. 9 and 10, FIG. 9 provides a perspective view of a portion of the light fixture shown in FIG. 3, and FIG. 10 provides a side view of FIG. 9. The first light module 145 and second light module 146 each include aiming assemblies. More particularly, the first light module 145 includes a first outboard aiming assembly 170 and a first inboard aiming assembly 174. The first outboard aiming assembly 170 includes a first outer rod support 154 secured to a frame body side 156 of the module base 144 of the first light module 145. In addition, the first inboard aiming assembly 174 includes a first center rod support 158 secured to a cross-member side 160 of the module base 144 of the first light module 145. The second light module 146 includes a second inboard aiming assembly 178 and a second outboard aiming assembly 180. The second inboard aiming assembly 178 includes a second center rod support 159 secured to a cross-member side 155 of a module base 144 of the second light module 146. The second outboard aiming assembly 180 includes a second outer rod support 161 secured to a frame body side 171 of the module base 144 of the second light module 146. In at least some embodiments, the rod supports 154, 158, 159, 161 can be formed integrally with each mounting base 144.

Figure 11:
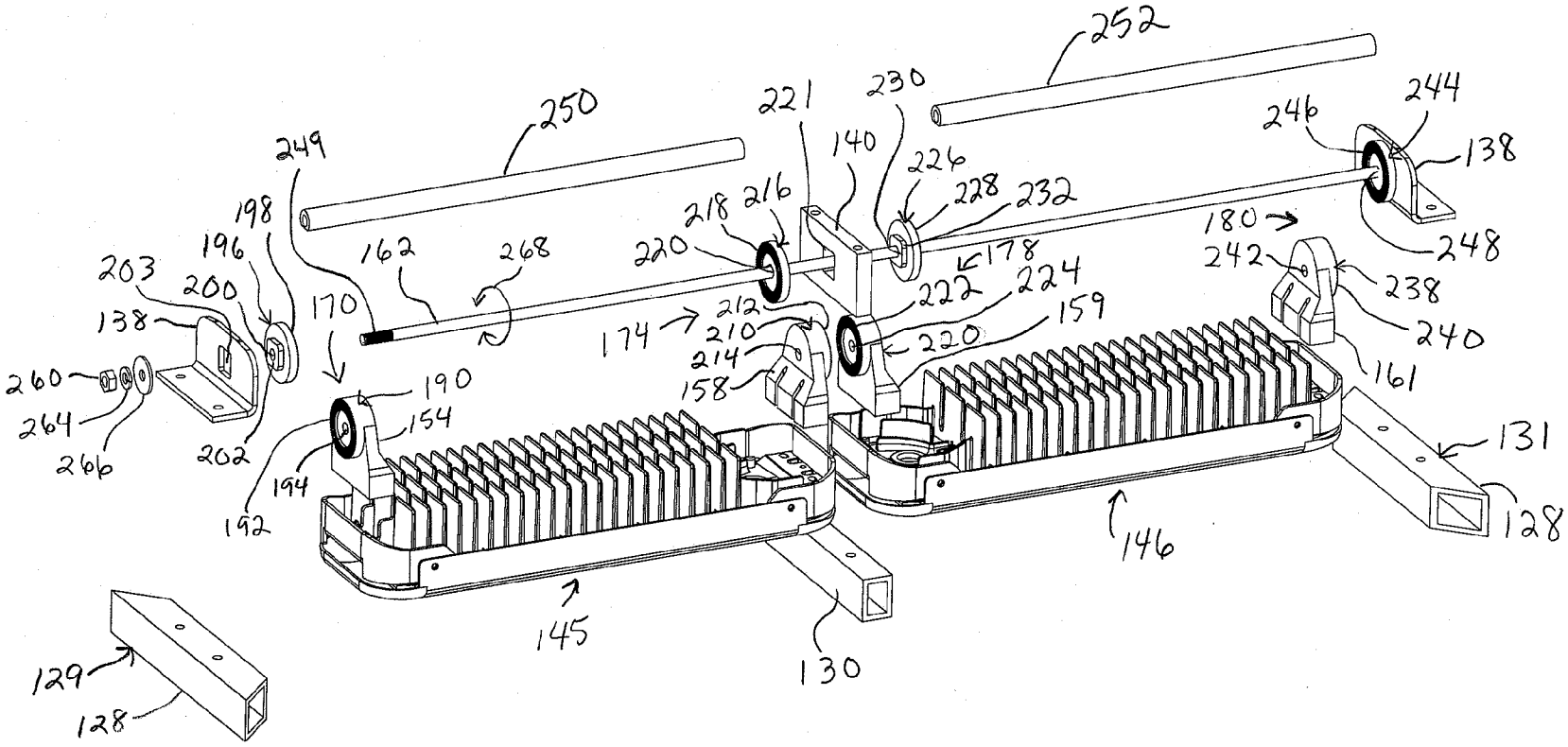
FIG. 11 is an exploded view of FIG. 10.

FIG. 11 is an exploded view of FIG. 10. As seen in FIG. 11, the first and second outer rod supports 154, 161 and the first and second inner rod supports 158, 159 each include an aperture (discussed below) for receiving a connecting member, such as connecting rod 162 therethrough. The connecting rod 162 provides a support, as well as a point of rotation for the first and second light modules 145, 146. In addition, the aiming assemblies 170, 174, 178, 180 (see FIG. 9) further include washers (discussed below) having apertures for receiving the connecting rod 162 therethrough.

With regard to the first outboard aiming assembly 170, the first outer rod support 154 includes a first outer aiming portion 190 with a plurality of protrusions, such as ridges 192 extending radially away from a central aperture 194. Although the term ridges is generally used in the specification (and shown in the Figures), these protrusions can include numerous different configurations that can serve to interlock or otherwise create a substantially non-moving engagement. The first outer aiming portion 190 is positioned to engage a first outboard washer 196 (as seen in FIG. 9) that also includes a plurality of ridges 198 extending radially away from a central aperture 200. The first outboard washer 196 further includes a locking protrusion 202 that is sized and shaped to engage a locking aperture 203 in the primary rod support 138. In this regard, when installed, rotation of the first outboard washer 196 can be prevented. Further, with regard to the first inboard aiming assembly 174, the first center rod support 158 includes a first inner aiming portion 210 with a plurality of ridges 212 extending radially away from a central aperture 214. The first inner aiming portion 210 is positioned to engage a first central washer 216 that also includes a plurality of ridges 218 extending radially away from a central aperture 200. The first central washer 216 further includes a locking protrusion (not visible, but similar to 202) that is sized and shaped to engage a locking aperture 221 in the secondary rod support 140. In this regard, when installed, rotation of the first central washer 216 can be prevented.

Referring to the second inboard aiming assembly 178, the second center rod support 159 includes a second inner aiming portion 220 with a plurality of ridges 222 extending radially away from a central aperture 224. The second inner aiming portion 220 is positioned to engage a second central washer 226 that also includes a plurality of ridges 228 extending radially away from a central aperture 230. The second central washer 226 further includes a locking protrusion 232 that is sized and shaped to engage a lock aperture 221 in the secondary rod support 140. In this regard, when installed, rotation of the second central washer 226 can be prevented. Further, with regard to the second outboard aiming assembly 180, the second outer rod support 161 includes a second outer aiming portion 238 with a plurality of ridges 240 extending radially away from a central aperture 242. The second outer aiming portion 238 is positioned to engage a second outboard washer 244 that also includes a plurality of ridges 246 extending radially away from a central aperture 248. The second outboard washer 244, in at least some embodiments, is secured to the primary rod support 138 to prevent rotation. As noted, each aiming assembly 170, 174, 178, 180 includes an aiming portion with ridges 192, 212, 222, 240 configured to interlock with ridges 198, 218, 228, 246 on a washer 196, 216, 226, 244, so as to prevent or substantially prevent rotation between the aiming portions and the ridges when forced together, as discussed below. As discussed above, the connecting rod 162 passes through the supports 154, 158, 159, 161, the washers 196, 216, 226, 244, the secondary rod support 140, and the primary rod supports 138. At the junction of the connecting rod 162 and the primary rod support 138 at the fixed frame side 131, adjacent the second outer rod support 161, the connecting rod 162 is secured to the primary rod support 138 to prevent rotation. This can be accomplished by various methods, such as welding the connecting rod 162 at least indirectly to the primary rod support 138.

Still referring to FIG. 11, a first rod spacer 250 and a second rod spacer 252 are provided. The first rod spacer 250 is positioned between the first outer rod support 154 and the first center rod support 158. The second rod spacer 252 is positioned between the second outer rod support 161 and the second center rod support 159. The rod spacers 250, 252 receive the connecting rod 162 therethrough and serve to maintain the distance between each pair of rod supports 154, 158, 159, 161 for each lighting module 145, 146. In at least some embodiments, the outer rod support and the inner rod support for each light module 136 can be joined to eliminate the need for a rod space. When the outer rod support and the inner rod support for a light module 136 is joined, it is to be understood that the outer rod support and inner rod support can each form a portion of the joined surface.

Turning to the adjusting frame side 129, a fastener, such as a threaded aiming nut 260, is provided for securement to a threaded portion 249 of the connecting rod 162 after it passes through the primary rod support 138. A securing lock washer 264 and a securing washer 266 can be included to further secure the aiming nut 260. As the connecting rod 162 is fixed at the fixed frame side 131 to prevent rotation, in at least some embodiments, the single aiming nut 260 is alone utilized to perform an aiming adjustment.

Referring generally to the figures, the light modules 136 are shown aimed directly forward, such that light emitted from the LEDs 152 is directed perpendicular to the front of the light fixture 102. Each of the light modules 136 can be positioned (aimed) to direct light in a particular direction. As discussed above, the light modules 145, 146 are rotationally secured to the connecting rod 162 to allow for repositioning in a rotational direction 268 (FIG. 11). The arrangement of the connecting rod 162, rod spacers 250, 252, and the aiming assemblies 170, 174, 178, 180 allow for adjustment of the position of the light modules 145, 146 by loosening a single associated aiming nut 260 to simultaneously remove the force on each of the four aiming assemblies 170, 174, 178, 180. More particularly, when the light modules 145, 146 have been aimed and are in a secured position, each pair of opposing ridges for each aiming assembly 170, 174, 178, 180 are forcibly engaged to prevent or substantially prevent rotation of the lighting modules 145, 146 (as described below). Unscrewing the aiming nut 260 to loosen it releases the force keeping the opposing ridges together, allowing them to disengage each other and rotate with respect to each other. Screwing the aiming nut 260 to tighten it restores the force, thereby re-engaging each set of opposing ridges to prevent or substantially prevent rotation.

The connecting rod 162 is secured to the primary rod support 138 at the fixed frame side 131 and therefore, when the aiming nut 260 is tightened at the primary rod support 138 on the adjusting frame side 129, the primary rod supports 138 are pulled inward towards each other, to establish a chain of forces between the primary rod supports 138. These forces converge about the engagement of the opposing ridges due to the connecting rod 162 passing through each of the aiming assemblies 170, 174, 178, 180 (via the central apertures 200, 194, 214, 224, 242, 248). In addition, the first and second rod spacers 250, 252 limit flexing of the outer aiming portions 190, 238 inward towards their respective inner aiming portions 210, 220, during tightening of the aiming nut 260. Although an aiming nut 260 and threaded portion 249 have been illustrated and described, various other methods of providing force can be utilized to pull the primary rod supports 138 inward toward each other, for example by a cam lever lock mechanism.

Referring again to FIGS. 2 and 3, it can be seen that a plurality of rows of light modules 136 are provided, where the light modules 136 are positioned in an end-to-end configuration, similar to the first and second light modules 145, 146. Each pair of light modules 136 is secured to the frame assembly 104 in the same manner as the first and second light modules 145, 146. More particularly, a connecting rod and aiming nut are provided for each pair of light modules 136 to allow for aiming of each of the light modules by adjusting the aiming nut. For example, as seen in FIG. 3, a second connecting rod 280, third connecting rod 282, fourth connecting rod 284, and fifth connecting rod 286 can be provided. Each connecting rod 280, 282, 284, 286 includes an aiming nut, namely, a second aiming nut 290, a third aiming nut (not shown), a fourth aiming nut 294, and a fifth aiming nut 296. Utilizing each of the aiming nuts, all of the light modules 136 can be easily aimed by loosening only five aiming nuts.

As discussed above, in at least some embodiments, the connecting rod 162 is fixed to prevent rotation at the primary rod support 138 on the fixed frame side 131. In at least some other embodiments, a secondary aiming nut (not shown) can be utilized along with another threaded portion (not shown) of the connecting rod 162 to provide the option of loosening the light modules 136 for an aiming adjustment from either side of the light fixture 102. Alternatively, when the secondary aiming nut is provided, the connecting rod 162 can be fixed at the adjusting frame side 129, thereby allowing adjustment from the fixed frame side 131 only. In addition, as discussed below, when the light modules 136 are not situated in an end-to-end configuration, the frame cross-member 130 is omitted, and the mounting base 144 is secured to an outer rod support 154 at each end.

Figure 12:
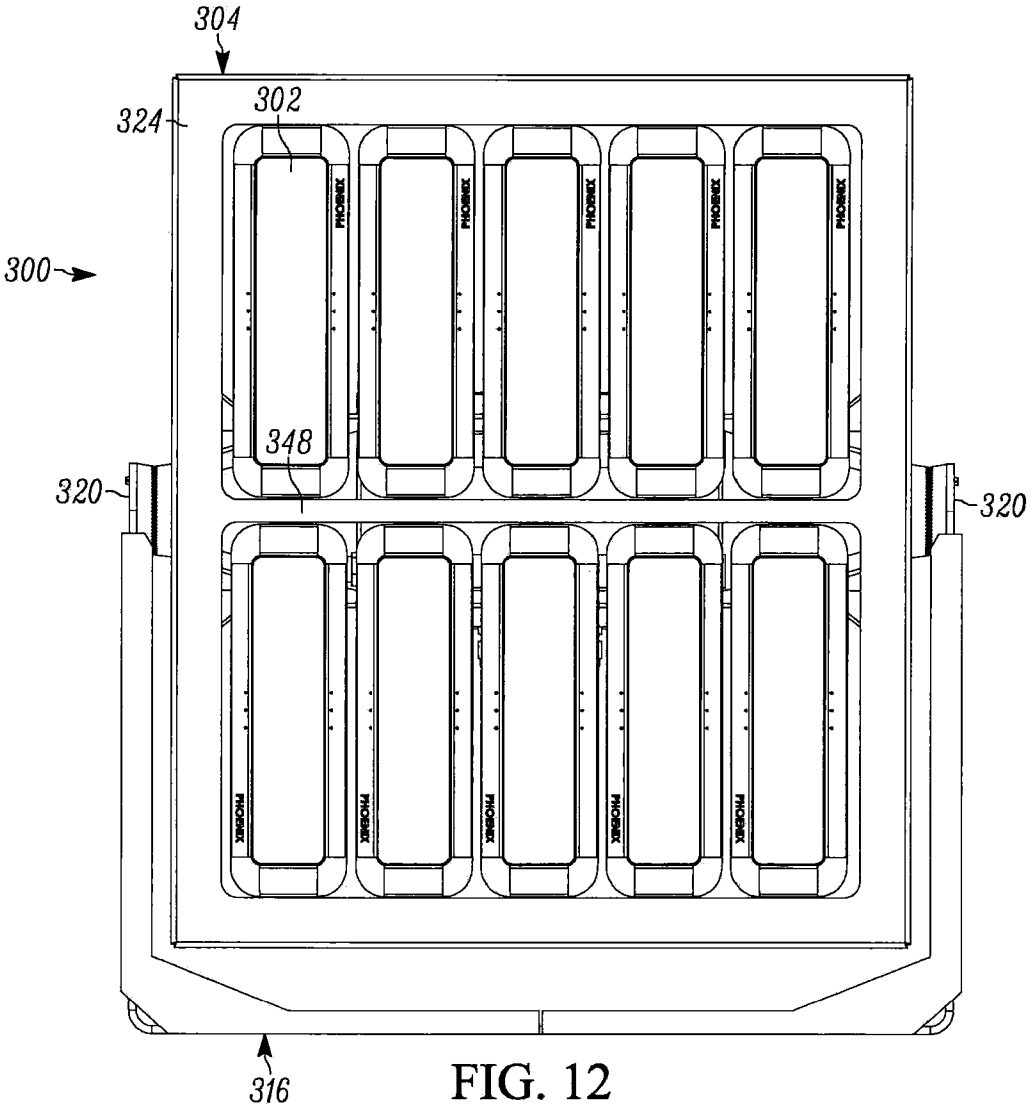
FIG. 12 is a front view of a second exemplary light fixture.
Figure 13:
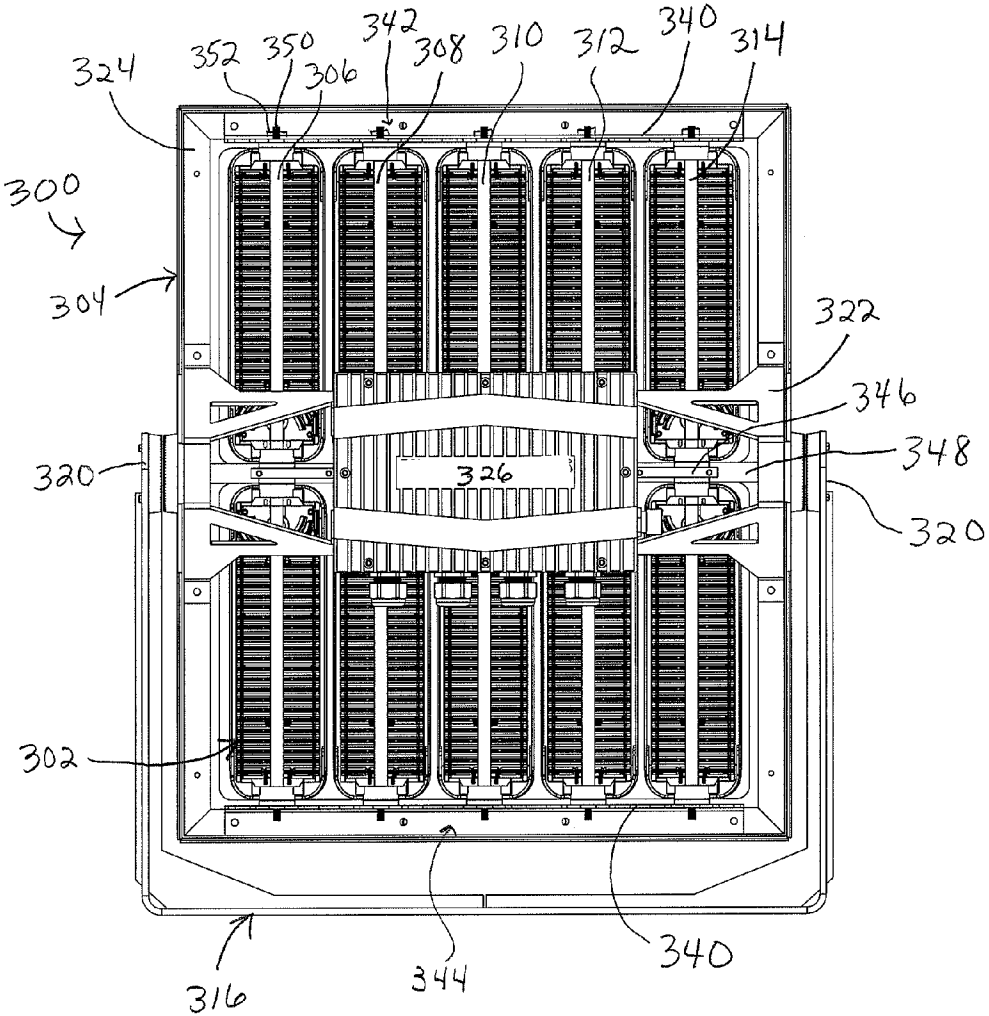
FIG. 13 is a rear view of FIG. 12.
Figure 15:
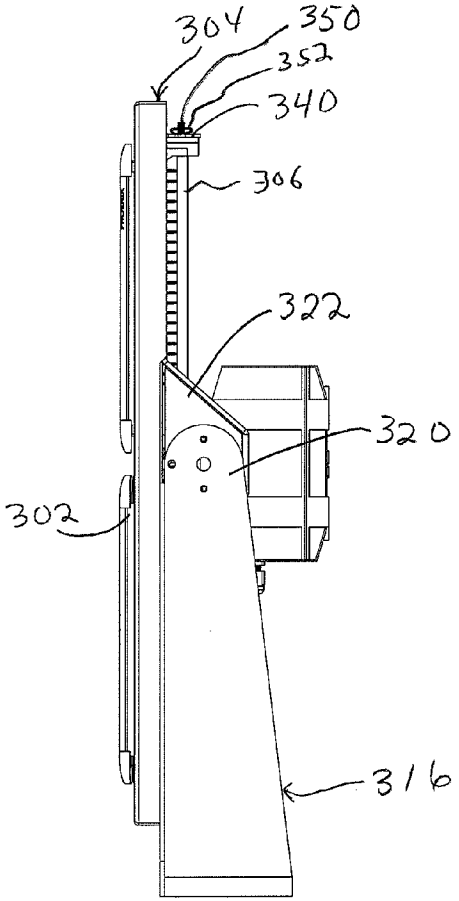
FIG. 15 is a right side view of FIG. 12.
Figure 14:
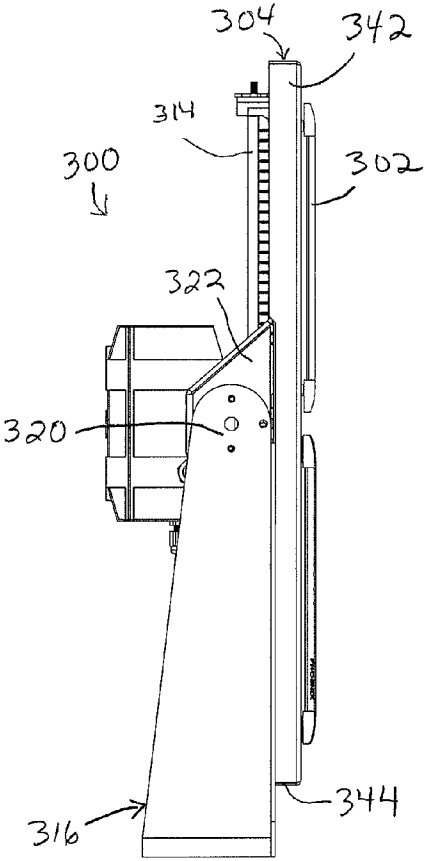
FIG. 14 is a left side view of FIG. 12.
Figure 16:
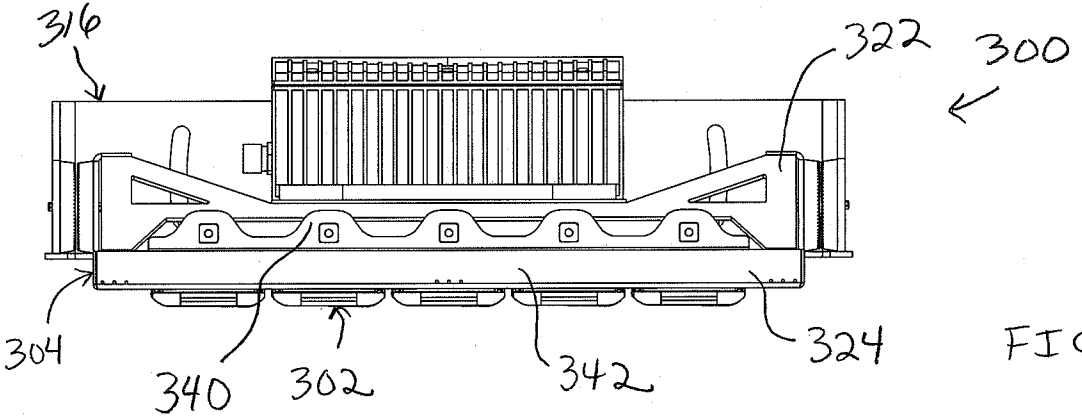
FIG. 16 is a top view of FIG. 12.
Figure 17:
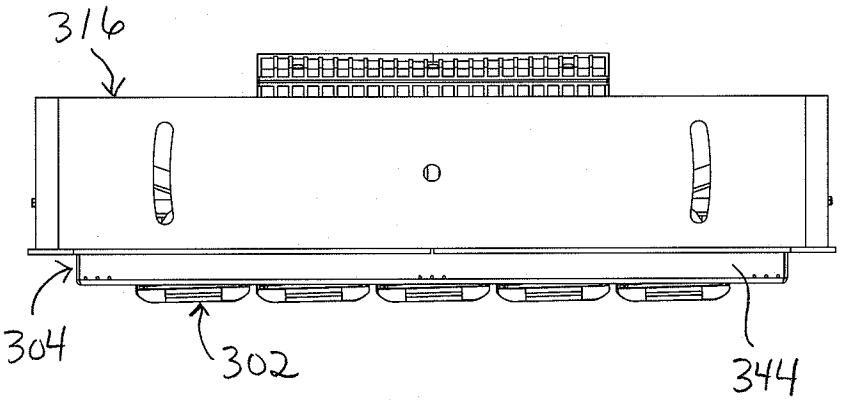
FIG. 17 is a bottom view of FIG. 12.

Referring now to FIGS. 12-16, an exemplary light fixture 300 is provided that includes adjustable light modules 302. FIGS. 12-13 illustrate a front and back view of a light fixture 300 with two rows and five columns of light modules 302 situated on a frame assembly 304. This configuration is in some regards a rotated version of the frame assembly 104 of the light fixture 102. The lighting modules 302 and connecting rods 306, 308, 310, 312, 314 are situated in a vertical orientation, in contrast to the light fixture 102, where the lighting modules and connecting rods are situated in a horizontal orientation. The light fixture 300 further includes a mounting bracket 316 with bracket support ends 320 that are rotatably secured to a frame support 322. A frame body 324 and a driver box 326 are secured to the frame support 322, similar to fixture 102.

One or more primary rod supports 340 are provided at each of an adjusting frame side 342 and a fixed frame side 344 for receiving the connecting rods 306, 308, 310, 312, 314. In addition, one or more secondary rod supports 346 are secured to a frame cross-member 348. Similar to light fixture 102, aiming assemblies are provided for rotationally securing the light modules to each of the connecting rods 306, 308, 310, 312, 314 in the same manner as described with reference to light fixture 102. Further, each connecting rod includes a threaded portion 350 configured to receive an aiming nut 352. As described above with reference to light fixture 102, the light modules 302 can be aimed by loosening the associated aiming nut and rotating the light modules 302 to a desired position, then tightening the aiming nut. FIGS. 14, 15, 16, 17 provide additional views of the light fixture 300, namely, a first side view, a second side view, a top view, and a bottom view, respectively.

Figure 18:
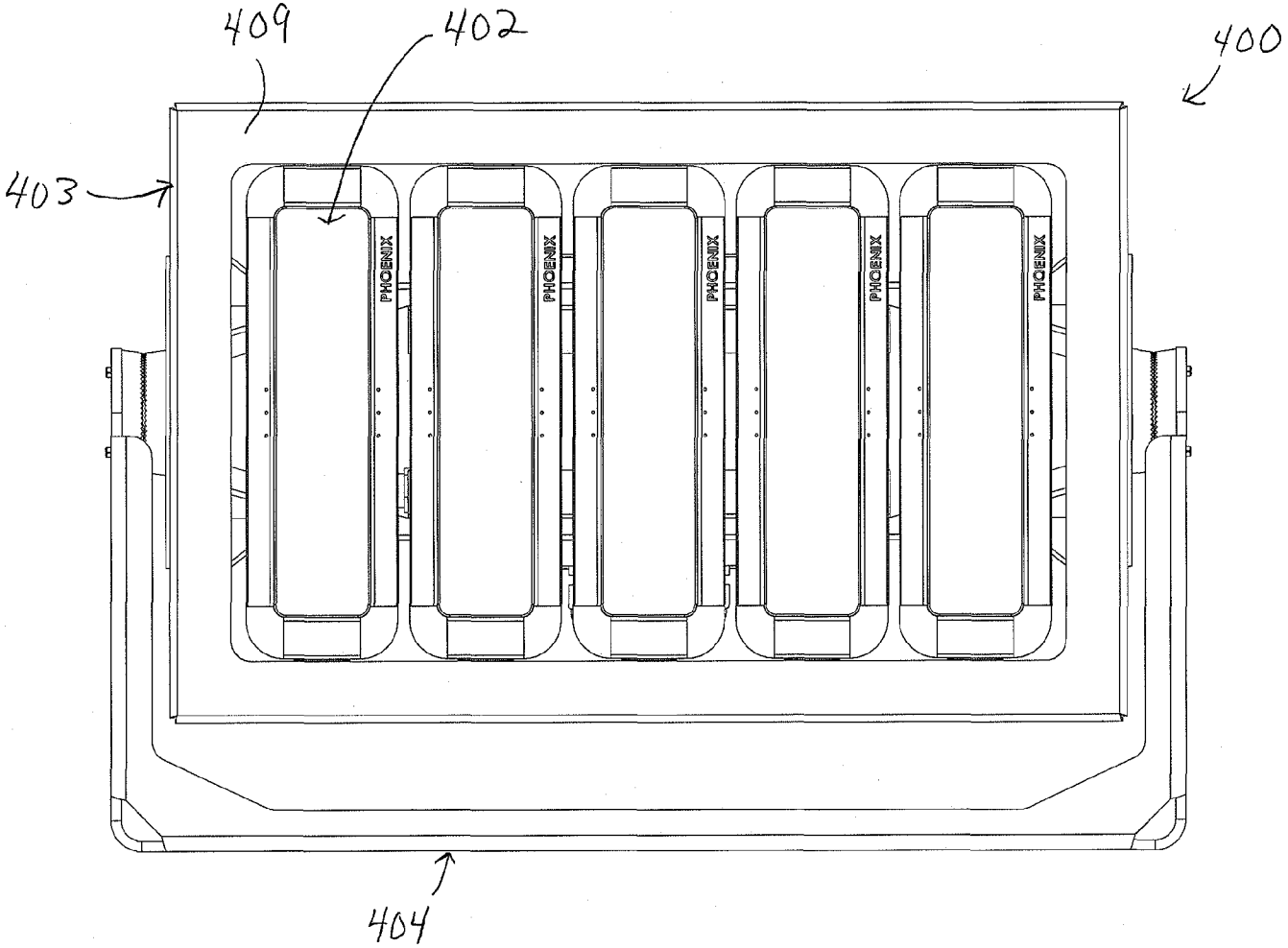
FIG. 18 is a front view of a third exemplary light fixture.
Figure 19:
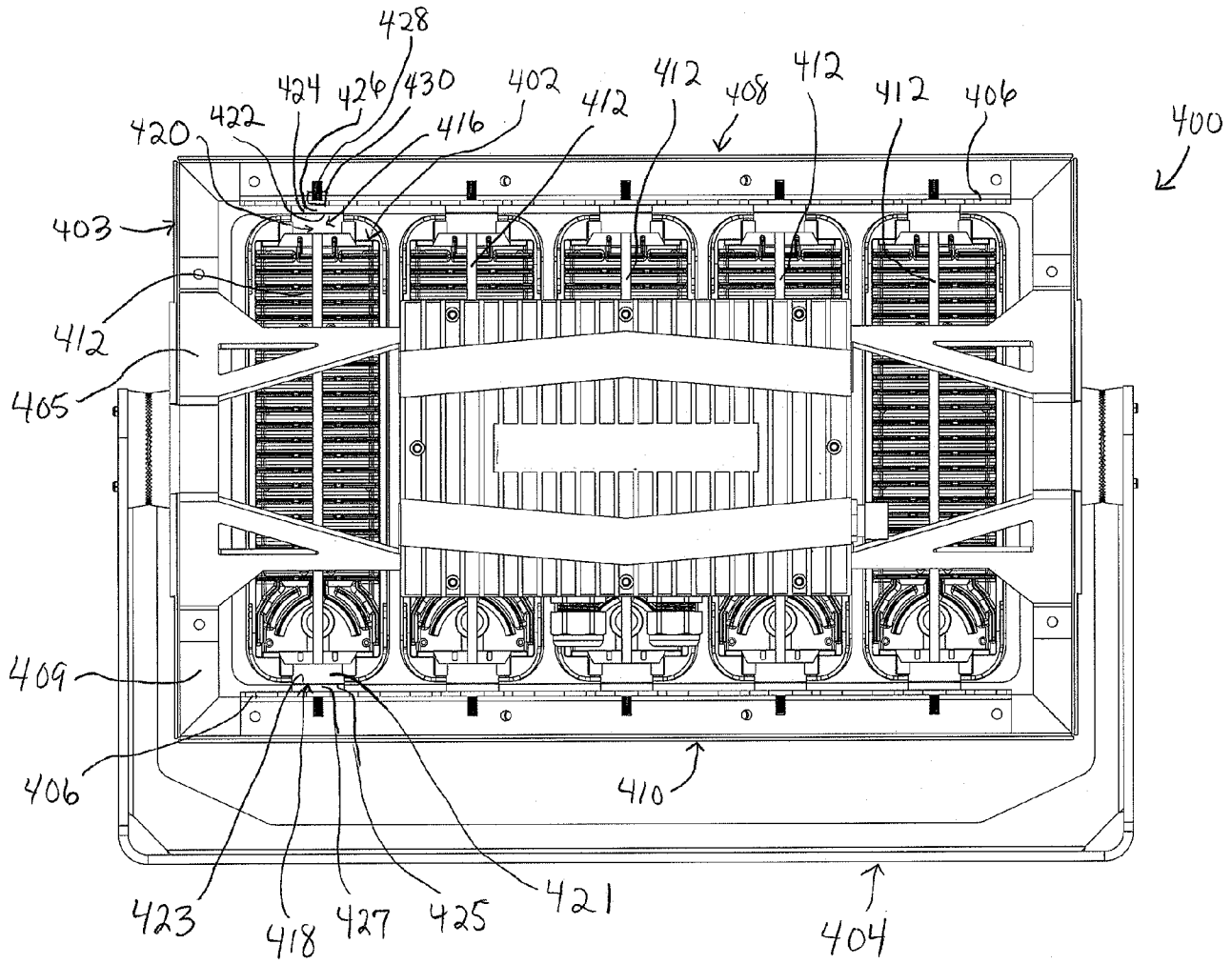
FIG. 19 is a rear view of FIG. 18.
Figure 20:
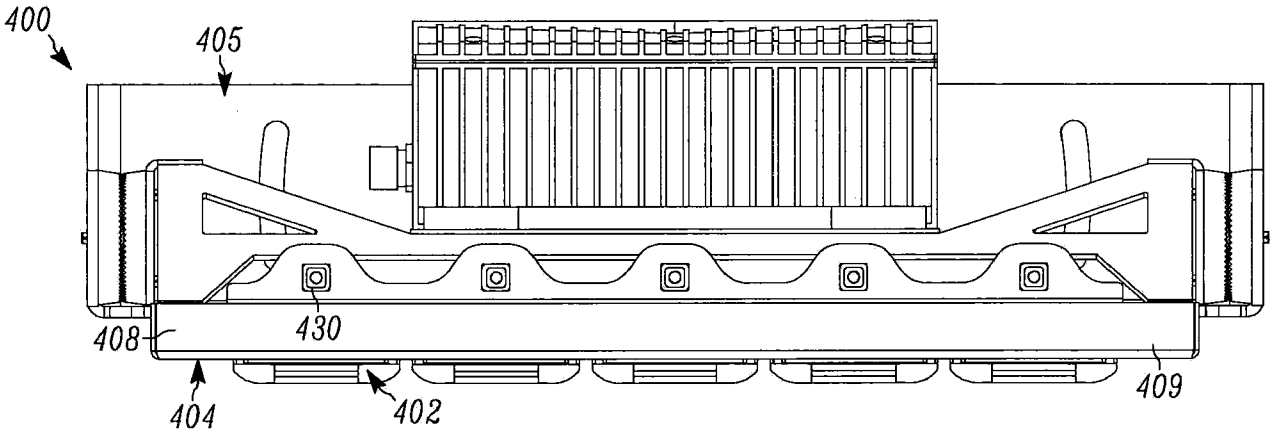
FIG. 20 is a top view of FIG. 18.

Referring to FIGS. 18 and 19, another exemplary light fixture 400 is provided that includes adjustable light modules 402 and a frame assembly 403 secured to a mounting bracket 404 by a frame support 405. FIG. 18 provides a front view of the light fixture 400, FIG. 19 provides a back view, and FIG. 20 provides a top view. The frame assembly 403 includes one or more primary rod supports 406 situated on an adjusting frame side 408 of a frame body 409, and one or more primary rod supports 406 situated on a fixed frame side 410 of the frame body 409. Each light module 402 is rotatably secured to the primary rod supports 406 by a connecting rod 412. As only a single row of light modules 402 are provided and they are positioned in a side-by-side arrangement and not longitudinally end-to-end (as seen in FIGS. 1 and 12), secondary rod supports are not provided to provide an intermediary support between light modules sharing a single connecting rod. Each light module 402 includes a first outboard aiming assembly 416 and a second outboard aiming assembly 418, which are similar to the aforementioned outboard aiming assemblies 170, 180. More particularly, the first outboard aiming assembly 416 includes a first outer aiming portion 420 having ridges 422 that are configured to matingly engage ridges 424 on a washer 426 that is interlocked with the primary rod support 406. Similarly, the second outboard aiming assembly 418 includes a second outer aiming portion 421 having ridges 423 that are configured to matingly engage ridges 425 on a washer 427 that is interlocked with the primary rod support 406. In addition, the connecting rods 412 further include at least one threaded portion 428 at an end for receiving and engaging an aiming nut 430. As with other embodiments, one or both ends of the connecting rods 412 can be threaded and receive aiming nuts 430, and one end can be fixed in position to prevent rotation of the connecting rod 412 upon rotation of the aiming nut 430 at the opposite end. However, in FIGS. 18-20 aiming nuts 430 are provided only on the adjusting frame side 408. In this manner, each light module 402 can be aimed independently by loosening a single associated aiming nut 430 to remove the force on the engaged ridges in both of the aiming assemblies 416, 418 simultaneously for a particular light module 402.

Figure 22:
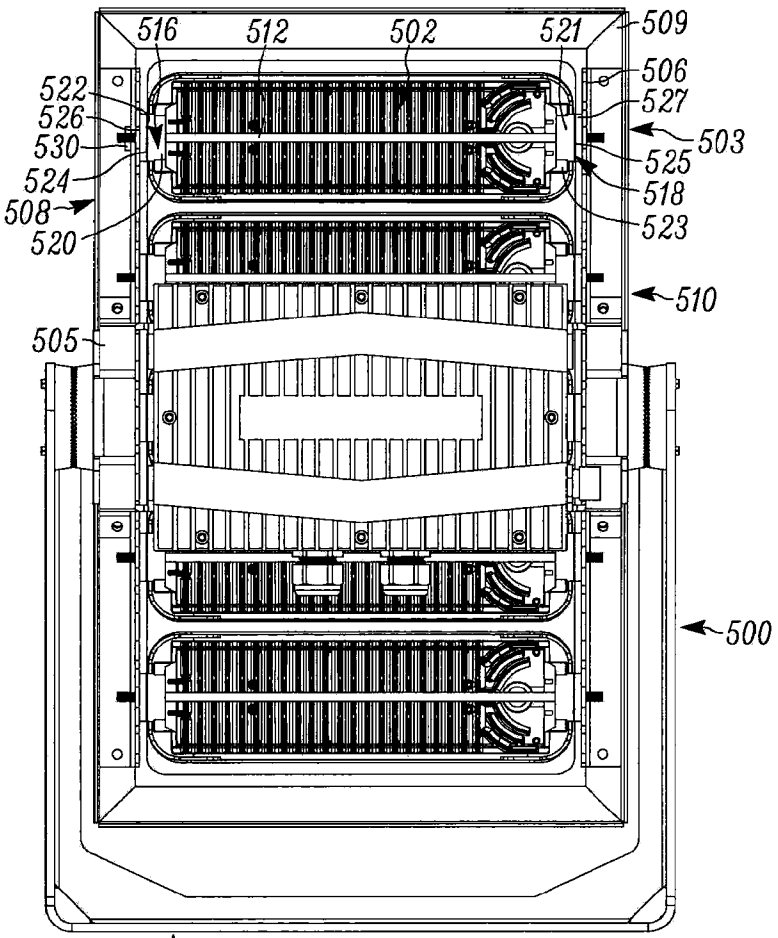
FIG. 22 is a rear view of FIG. 21.
Figure 21:
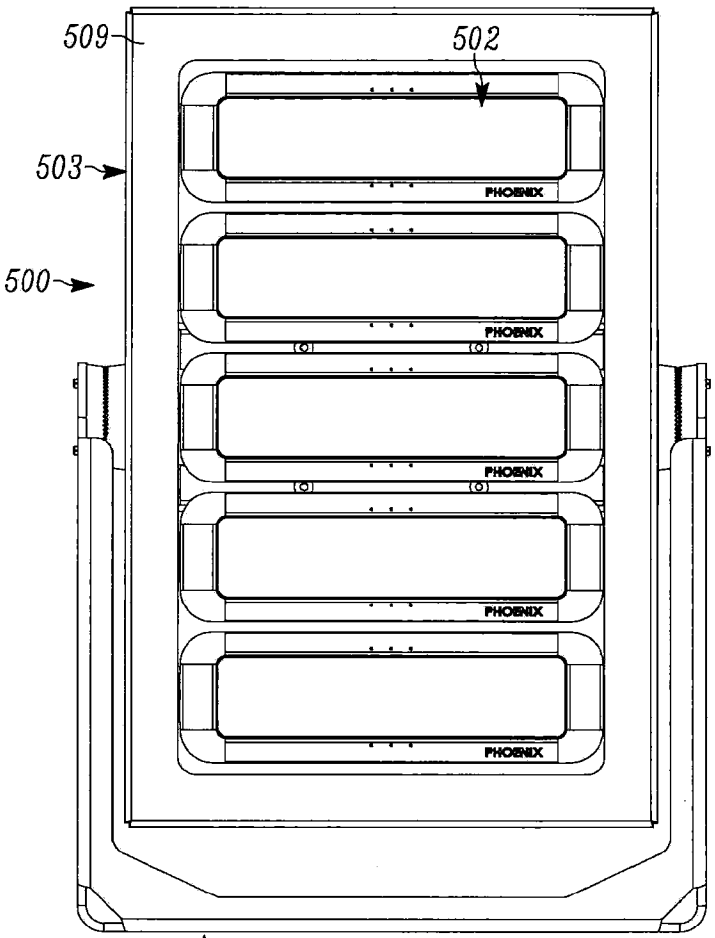
FIG. 21 is a front view of a fourth exemplary light fixture.

Referring to FIGS. 21 and 22, a front and rear view of another exemplary light fixture 500 is provided that includes adjustable light modules 502 and a frame assembly 503 secured to a mounting bracket 504 by a frame support 505. The frame assembly 503 includes one or more primary rod supports 506 situated on an adjusting frame side 508 of a frame body 509, and one or more primary rod supports 506 situated on a fixed frame side 510 of the frame body 509. Each light module 502 is rotatably secured to the primary rod supports 506 by a connecting rod 512. As only a single column of light modules 502 are provided and they are positioned in a top-to-bottom configuration and not longitudinally end-to-end (as seen in FIGS. 1 and 12), secondary rod supports are not provided. Each light module 502 includes a first outboard aiming assembly 516 and a second outboard aiming assembly 518, which are similar to the aforementioned outboard aiming assemblies 170, 180. More particularly, the first outboard aiming assembly 516 includes a first outer aiming portion 520 having ridges 522 that are configured to matingly engage ridges 524 on a washer 526 that is interlocked with the primary rod support 506. Similarly, the second outboard aiming assembly 518 includes a second outer aiming portion 521 having ridges 523 that are configured to matingly engage ridges 525 on a washer 527 that is interlocked with the primary rod support 506. In addition, the connecting rods 512 further include at least one threaded portion 528 at an end for receiving and engaging an aiming nut 530. As with other embodiments, one or both ends of the connecting rods 512 can be threaded and receive aiming nuts 530, and one end can be fixed in position to prevent rotation of the connecting rod 512 upon rotation of the aiming nut 530 at the opposite end. However, in FIGS. 20 and 21 aiming nuts 530 are provided only on the adjusting frame side 508. In this manner, each light module 502 can be aimed independently by loosening a single associated aiming nut 530 to remove the force on the engaged ridges in both of the aiming assemblies 516, 518 simultaneously for a particular light module 502.

FIGS. 1-11 depict only a pair of light modules 136 situated in an end-to-end configuration with a single connecting rod extending therethrough, although in at least some embodiments, three or more light modules 136 can be situated in an end-to-end configuration with a single connecting rod extending therethrough. In such an embodiment, additional frame cross-members, each with a secondary rod support can be positioned in the frame assembly 104, in-between a primary rod support and another cross-member. Further in such an embodiment, each light module 136 would include one or more aiming mechanisms.

As the various exemplary embodiments described above include numerous similar or identical components, not all of the components for each embodiment have been discussed or identified with regard to each of the figures. In particular, like named components (e.g., aiming nut 260, aiming nut 352, aiming nut 430, ridges 198, ridges 212, ridges 218, etc.) should be understood to, in at least some embodiments, include similar features and/or perform similar functions. In addition, although not all similar components are identified with reference numerals in each of the figures, such components should be understood to be identified as similar components by their illustration in figures where they are identified. Further, in some instances, the names of various reference points have been repeated but with different numbers (e.g., cross-member side 155, cross-member side 160, etc.). This can occur when the reference points are similar between two similar objects (e.g., light module 145 and light module 146). Additionally, each light module in the figures is intended to be identical, although in at least some embodiments, the light modules can be different, including alternate shapes and light sources for example.

Each of the components described herein can be manufactured from one of a variety of materials suitable for the environment of intended use. Further, for clarity, various items have been omitted from the figures, such as wiring between the light modules 136 and the driver box 134, as such electrical interconnections between light sources and driver boxes are well known in the art. It is specifically intended that the present invention not be limited to the embodiments and illustrations contained herein, but include modified forms of those embodiments including portions of the embodiments and combinations of elements of different embodiments as come within the scope of the following claims.

We claim:

1. A light fixture comprising:

a frame assembly having a first primary rod support and a second primary rod support;

a first connecting rod having a first end and a second end, the ends extending substantially between the first primary rod support and the second primary rod support;

a plurality of aiming assemblies, each configured to receive the first connecting rod therethrough, the aiming assemblies including opposing engaging protrusions, wherein one or more aiming assemblies are secured to a first light module that includes one or more light sources and one or more aiming assemblies are secured to a second light module that includes one or more light sources;

a first fastener for releasably securing the first end of the first connecting rod to the first primary rod support, wherein the second end of the first connecting rod is secured to the second primary rod support, wherein when the first fastener is in a fastened position, the first and second primary rod supports are forced inwards towards each other to provide an engaging force on the opposing engaging portions of the aiming assemblies to prevent rotation of the first light module about the first connecting rod, and wherein when the first fastener is in an unfastened position, the first and second light modules are both rotatable about the first connecting rod.

2. The light fixture of claim 1, wherein the one or more aiming assemblies include a first outboard aiming assembly and a first inboard aiming assembly, both secured to the first light module, and a second outboard aiming assembly and a second inboard aiming assembly, both secured to the second light module.

3. The light fixture of claim 2, wherein the first light module is rotationally secured to the first connecting rod by the first outboard aiming assembly and the first inboard aiming assembly, and the second light module is rotationally secured to the first connecting rod by the second outboard aiming assembly and the second inboard aiming assembly.

4. The light fixture of claim 3, wherein the first outboard aiming assembly includes a first outboard washer and a first outer rod support, and wherein the first inboard aiming assembly further includes a first inboard washer and a first center rod support.

5. The light fixture of claim 4, wherein the second inboard aiming assembly includes a second inboard washer and a second center rod support, and wherein the second outboard aiming assembly further includes a second outboard washer and a second outer rod support.

6. The light fixture of claim 5, wherein the first outboard washer is secured to the first primary rod support, and the first outer rod support is secured to the first light module, and wherein the first outboard washer includes one or more of the opposing engaging protrusions which matingly engage with one or more of the opposing engaging protrusions positioned on the first outer rod support.

7. The light fixture of claim 6, wherein the second outboard washer is secured to the second primary rod support, and the second outer rod support is secured to the second light module, and wherein the second outboard washer includes one or more of the opposing engaging protrusions which matingly engage with one or more of the opposing engaging protrusions positioned on the second outer rod support.

8. The light fixture of claim 7, further including a cross-member secured to the frame assembly with a secondary rod support secured thereto, wherein the first inboard washer is secured to the secondary rod support, and the first center rod support is secured to the first light module, and wherein the first inboard washer includes one or more of the opposing engaging protrusions which matingly engage with one or more of the opposing engaging protrusions positioned on the first center rod support.

9. The light fixture of claim 8, wherein the second inboard washer is secured to the secondary rod support, and the second center rod support is secured to the second light module, and wherein the second inboard washer includes one or more of the opposing engaging protrusions which matingly engage with one or more of the opposing engaging protrusions positioned on the second center rod support.

10. The light fixture of claim 9, further including one or more additional cross-members each with an additional secondary rod support secured thereto, wherein the one or more additional cross-members are positioned between the first cross-member and one of the first and second primary rod supports, and wherein one or more additional light modules receive the first connecting rod therethrough and are positioned between the one or more additional cross-members and the first and second primary rod supports.

11. The light fixture of claim 9, further including third and fourth light modules secured to the frame assembly at least indirectly by a second connecting rod, wherein the second connecting rod is positioned substantially parallel to the first connecting rod, and wherein the third and fourth light modules can be aimed by fastening and unfastening a second fastener associated with the second connecting rod.

12. The light fixture of claim 9, wherein the second end of the first connecting rod is secured to the second primary rod support by a second fastener.

13. The light fixture of claim 9, wherein the first and second light modules include one or more lighting emitting diode light sources secured thereto.

14. The light fixture of claim 9, further including a driver box secured to a frame support attached to the frame assembly.

15. A light fixture comprising:

a frame assembly having a first primary rod support and a second primary rod support;

a connecting rod having a first end and a second end, the ends extending substantially between the first primary rod support and the second primary rod support;

a first and a second aiming assembly, both configured to receive the connecting rod therethrough, the two aiming assemblies including opposing engaging protrusions, wherein the aiming assemblies are secured to a first light module that includes one or more light sources and the first light module is rotatable with respect to the connecting rod; and a first fastener for releasably securing the first end of the connecting rod to the first primary rod support, wherein the second end of the connecting rod is secured to the second primary rod support, wherein when the first fastener is in a fastened position, the first and second primary rod supports are forced inwards towards each other to provide an engaging force on the opposing engaging portions of the aiming assemblies to prevent rotation of the first light module about the connecting rod, wherein when the first fastener is in an unfastened position, the first light module is rotatable about the connecting rod; and wherein the first and second aiming assemblies secured to the first light module include a first outboard aiming assembly and a second outboard aiming assembly.

16. The light fixture of claim 15, wherein the first outboard aiming assembly further includes a first outboard washer and a first outer rod support and the second outboard aiming assembly includes a second outboard washer and a second outer rod support.

17. The light fixture of claim 16, wherein the first outboard washer is secured to the first primary rod support and the first outer rod support is secured to the light module, and wherein the first outboard washer includes one or more protrusions configured to matingly engage with one or more protrusions on the first outer rod support.

18. The light fixture of claim 17, wherein the second outboard washer is secured to the second primary rod support and the second outer rod support is secured to the light module, and wherein the second outboard washer includes one or more protrusions configured to matingly engage with one or more protrusions on the second outer rod support.

* * * * *